US007051881B2

(12) United States Patent
Hesse et al.

(10) Patent No.: US 7,051,881 B2
(45) Date of Patent: May 30, 2006

(54) COLLECTOR FOR NON IRON METAL SULPHIDE PREPARATION

(75) Inventors: Heinrich Hesse, Hattersheim (DE); Jaime Gomez, Santiago de Chile (CL); Miguel Angel Arends, Santiago de Chile (CL); Norbert Ernstorfer, Santiago de Chile (CL)

(73) Assignee: Clariant International Ltd., Muttenz (CH)

( * ) Notice: Subject to any disclaimer, the term of this patent is extended or adjusted under 35 U.S.C. 154(b) by 520 days.

(21) Appl. No.: 10/415,578

(22) PCT Filed: Oct. 31, 2001

(86) PCT No.: PCT/EP01/12628

§ 371 (c)(1),
(2), (4) Date: Apr. 30, 2003

(87) PCT Pub. No.: WO02/38277

PCT Pub. Date: May 16, 2002

(65) Prior Publication Data

US 2004/0099836 A1 May 27, 2004

(30) Foreign Application Priority Data

Nov. 7, 2000 (DE) ..... 100 55 126

(51) Int. Cl.
*B03D 1/012* (2006.01)
*B03D 1/02* (2006.01)

(52) U.S. Cl. ..... 209/166; 252/61

(58) Field of Classification Search ..... 209/166; 252/61

See application file for complete search history.

(56) References Cited

U.S. PATENT DOCUMENTS

| | | | | |
|---|---|---|---|---|
| 1,640,218 | A * | 8/1927 | Sayre | 209/166 |
| 1,674,166 | A * | 6/1928 | Douglass | 209/166 |
| 2,029,156 | A * | 1/1936 | Christmann et al. | 209/166 |
| 2,691,635 | A * | 10/1954 | Harris et al. | 252/61 |
| 4,387,034 | A * | 6/1983 | Unger et al. | 252/61 |
| 4,601,818 | A * | 7/1986 | Bresson et al. | 209/166 |
| 4,699,711 | A | 10/1987 | Bergman et al. | 209/166 |
| 4,908,125 | A | 3/1990 | Mackenzie et al. | 209/166 |
| 4,946,585 | A | 8/1990 | Lambert | 209/166 |
| 5,126,038 | A | 6/1992 | Nagaraj | 209/166 |
| 5,232,581 | A | 8/1993 | Roberts et al. | 209/166 |
| 5,929,408 | A * | 7/1999 | Gutierrez et al. | 209/166 |

FOREIGN PATENT DOCUMENTS

| | | |
|---|---|---|
| DE | 1 190 864 | 1/1970 |
| EP | 0 298 392 | 1/1989 |
| WO | WO 94/23841 | 10/1994 |
| WO | WO 98/13142 | 4/1998 |

OTHER PUBLICATIONS

English abstract for DE 1930864, Jan. 8, 1970.
Copy of the publication of the corresponding German Patent No. 1005526, granted May 23, 2002.
Schubert: Aufbereitung fester mineralischer Rohstoffe, Band II, 1977, pp. 296-299.
Schubert: Aufbereitung fester mineralischer Rohstoffe, Band II, 1977, pp. 300-305.
Woods, R., et al., "Surface enhanced raman scattering spectroscopic studies of the adsorption of flotation collectors", Minerals Engineering, vol. 13, No. 4, pp. 345-356.

* cited by examiner

*Primary Examiner*—Thomas M. Lithgow
(74) *Attorney, Agent, or Firm*—Richard P. Silverman

(57) ABSTRACT

The present invention relates to a flotation reagent and a process for the flotation of sulfidic ores. The process comprises contacting the sulfidic ores with a combination of thionocarbamates and mercaptobenzothiazoles to improve the flotation of sulfidic ores, particularly the flotation of copper ore when the copper ore is associated with molybdenum and/or gold. The flotation reagent comprises a combination of compounds of formula (1)

(1)

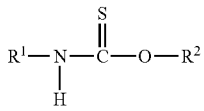

and formula (2)

(2)

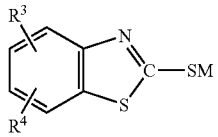

where $R^1$ and $R^2$ independently of one another are alkyl groups having 1 to 18 carbon atoms, and $R^3$ and $R^4$ independently of one another are hydrogen or $C_1$–$C_6$-alkyl, and M is hydrogen or an alkali metal, and (1) and (2) are in a weight ratio of (1):(2) of 95:5 to 75:25.

10 Claims, No Drawings

COLLECTOR FOR NON IRON METAL SULPHIDE PREPARATION

The present invention relates to the use of mixtures of thiocarbamates and mercaptobenzothiazoles as collectors for ores, in particular sulfidic ores.

The separation of minerals is achieved by a number of different processes, for example electrostatic or magnetic separation. However, in order to separate finely divided ores, the flotation process is the only economically justifiable method. The other processes are either only applicable to certain minerals or are restricted to special mineral combinations. Flotation utilizes the differing chemical properties of the surface of various minerals and can be carried out using a multiplicity of differing chemicals.

In the flotation process, the various minerals can be separated by adding chemicals which control the wettability of the individual minerals in the flotation pulp.

These chemicals can be roughly divided into a few categories, that is to say collectors, frothers, depressants, activators and modifiers.

Collectors are reagents which principally ensure that the mineral of value becomes hydrophobic. They are surface-active organic substances which are adsorbed to the surface of the mineral. Collectors contain a polar functional group which, because of its hydrophilicity, is bound to the mineral surface, and a nonpolar group which, owing to its hydrophobicity, is attached to an air bubble. The hydrophobic part of the collector is usually a hydrocarbon radical. Collectors are classified either on the basis of their functional group or according to the type of mineral connected.

Important commercially available collectors are xanthates, dithiophosphates and thionocarbamates (Schubert: Aufbereitung fester mineralischer Rohstoffe [Processing of solid mineral raw materials], volume II, 1977, pp. 296 ff). However, in some cases (for example when complex mixed ores are present), the recovery and selectivity achievable using these standard collectors is completely unsatisfactory, so that special collector types are required.

Thionocarbamates are selective and highly active collectors for many sulfide minerals, particularly for copper minerals and zinc blende. The main field of application is the flotation of copper ores in which the minerals of value present are especially copper glance (chalcosine $Cu_2S$), indigo copper (covelline CuS), copper pyrites (chalcopyrite $CuFeS_2$), peacock ore (bornite $Cu_5FeS_4$) and tetrahedrite ($Cu_{12}Sb_4S_{13}$). A high selectivity of thionocarbamate is of importance, especially in the case of ores where the copper minerals are accompanied by greater contents of iron sulfide minerals (pyrites, marcasite, pyrrhotite, arsenopyrite).

U.S. Pat. No. 4,699,711 discloses a method for froth flotation of sulfide minerals, in particular copper-bearing sulfide minerals, and a corresponding collector. This collector, in a preferred embodiment, comprises short-chain alkyl-substituted thionocarbamates.

Mercaptobenzothiazole is, in the neutral to acidic range, a highly active all round collector for all sulfide minerals of Ag, Cu, Pb, Zn, Bi, Sb, As, Ni, Co, Mo and Fe, and of elemental metals such as Cu, Bi, Ag, Au and PGM (platinum group metals). In many cases the strongest xanthates (K amylxanthate, K hexylxanthate) exceed its activity, which does not apply at low pHs (<4) at which xanthates lose their activity. Mercaptobenzothiazole can be used either alone or in combination with other sulfhydryl collectors such as xanthates, aromatic and aliphatic dithiophosphates, thiocarbamates, xanthogenic esters etc. Mercaptobenzothiazole reinforces the activity and selectivity of the other collectors, the choice of which is determined by the mineral to be flotated and the character of the ore.

Thionocarbamates and mercaptobenzothiazoles are described in Schubert: Aufbereitung fester mineralischer Rohstoffe [Processing of solid mineral raw materials], volume II, 1977, pp. 300 ff.

O-Isopropyl N-ethylthionocarbamate and 2-mercaptobenzothiazole are described in R. Woods et al., Minerals Engineering, Vol. 13, No. 4, pp. 345–356 as collectors for copper minerals. However, the document does not mention any mixtures of these substances as suitable collectors.

EP-A-0 298 392 discloses a flotation method and a collector for sulfidic minerals. The collector consists of a primary or secondary amine which bears alkyl or alkenyl substituents having 8 to 22 carbon atoms, and also a sulfur compound. The sulfur compounds mentioned are, inter alia, mercaptobenzothiazoles and thionocarbamates, but not mixtures thereof.

It was an object of the present invention to find an improved flotation reagent for sulfidic ores, in particular for copper ore, in which case the reagent is to be suitable in particular for those ores which are associated with further minerals of value. The flotation reagent is, furthermore, to be effective in lower amounts than the flotation reagents of the prior art.

Surprisingly, it has now been found that thionocarbamates in combination with mercaptobenzothiazoles improve the flotation of sulfidic ores, in particular the flotation of copper ore which is associated with molybdenum and/or gold.

The invention thus relates to a flotation reagent comprising compounds of the formula (1)

(1)

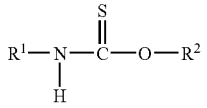

and (2)

(2)

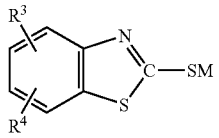

where $R^1$ and $R^2$ independently of one another are alkyl groups having 1 to 18 carbon atoms, and $R^4$ and $R^4$ independently of one another are hydrogen or $C_1$–$C_6$-alkyl, and M is hydrogen or an alkali metal, in a weight ratio of (1):(2)=95:5 to 75:25.

The invention further relates to the use of the inventive flotation reagent for the flotation of sulfidic ores. The sulfidic ores are preferably copper-bearing ores.

$R^1$ and $R^2$ can be straight-chain or branched radicals. They are preferably $C_1$–$C_6$-alkyl, in particular $C_1$–$C_3$-alkyl. The compound of the formula (1) is, in a preferred embodiment, O-isopropyl N-ethylthionocarbamate (IPETC).

$R^3$ and $R^4$ can be at any of the free aromatic positions. They are preferably $C_1$–$C_3$-alkyl, in particular H. M is preferably Na.

The mixing ratio of the compounds of the formulae 1 and 2 is preferably between 93:7 and 80:20, in particular between 92:8 and 87:13, by weight.

In a further preferred embodiment of the invention, the inventive flotation reagent comprises up to 50% by weight, based on the weight of the flotation reagent, of diethylene glycol or mono- or diethanolamine.

The inventive flotation reagent is preferably essentially free from alkyl- or alkenyl-substituted amines in which the alkyl or alkenyl groups do not contain hydroxyl groups.

Using the inventive flotation reagent, improved results for selectivity and yield can be achieved compared with standard collectors in the flotation of non-Fe-metal sulfides.

All metal sulfides (apart from Fe) can be flotated, with particular mention being made of Cu, Mo, Pb, Zn and Ni. Particularly good results may be observed in the processing of Cu, Zn and Mo. The inventive flotation reagent is usable in a wide pH range (2 to 12) and is added to the aqueous pulp at a concentration between preferably 0.01 and 1.0 kg/metric ton of pulp.

By means of the inventive flotation reagent, especially in the case of complex Cu-bearing mixed ores, a significant improvement in selectivity and recoveries is achieved.

EXAMPLE

Preparation of the Collector Mixture

The components are mixed at 50 to 80° C. in a stirred tank until a homogeneous solution is present.

Applications studies: flotation of chalcopyrite

| Ex. No. | Feed % Cu | Concen. % Cu | Waste % Cu | Amount % | Recovery of Cu | Collector type | Addition g/l |
|---|---|---|---|---|---|---|---|
| 1 (V) | 1.41 | 9.7 | 0.14 | 13.3 | 91.4 | thionocarbamates* | 22 |
| 2 (V) | 1.41 | 10.8 | 0.13 | 12.0 | 91.9 | thionocarbamates* | 22 |
| AVR 1-2 | 1.41 | 10.3 | 0.14 | 12.7 | 91.7 | thionocarbamates* | 22 |
| 3 (V) | 1.42 | 11.4 | 0.14 | 11.4 | 91.3 | thionocarbamates* | 22 |
| 4 (V) | 1.42 | 11.3 | 0.12 | 11.7 | 92.5 | thionocarbamates* | 22 |
| AVR 3-4 | 1.42 | 11.3 | 0.13 | 11.6 | 91.9 | thionocarbamates* | 22 |
| 5 | 1.42 | 11.5 | 0.15 | 11.19 | 90.6 | Na-mercaptobenzo-thiazole | 22 |
| 6 | 1.41 | 11.2 | 0.14 | 11.48 | 91.2 | Na-mercaptobenzo-thiazole | 22 |
| AVR 5-6 | 1.42 | 11.4 | 0.15 | 11.34 | 90.9 | Na-mercaptobenzo-thiazole | 22 |
| 7 | 1.42 | 12.1 | 0.12 | 10.9 | 92.5 | inventive collector** | 22 |
| 8 | 1.40 | 13.9 | 0.12 | 9.3 | 92.2 | inventive collector | 22 |
| AVR 7-8 | 1.41 | 13.0 | 0.12 | 10.1 | 92.4 | inventive collector | 22 |

*O-Isopropyl N-ethylthionocarbamate

**The inventive collector is a mixture of 65% by weight N-ethyl O-isopropylthionocarbamate, 5% by weight mercaptobenzothiazole sodium salt and 30% by weight diethylene glycol, AVR = mean

The invention claimed is:

1. A flotation reagent comprising compounds of the formula (1)

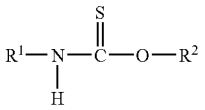

(1)

and (2)

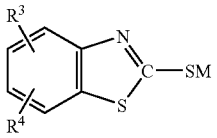

(2)

where $R^1$ and $R^2$ independently of one another are alkyl groups having 1 to 18 carbon atoms, and $R^3$ and $R^4$ independently of one another are hydrogen or $C_1$–$C_6$-alkyl, and M is hydrogen or an alkali metal, in a mixing ratio of (1):(2)=95:5 to 75:25 by weight.

2. The flotation reagent of claim 1, wherein $R^1$ and $R^2$ independently of one another are $C_2$ to $C_6$-alkyl groups.

3. The flotation reagent of claim 1, wherein $R^3$ and $R^4$ independently of one another are hydrogen or $C_1$ to $C_3$-alkyl groups.

4. The flotation reagent of claim 1, wherein the mixing ratio is between 93:7 and 80:20 by weight.

5. The flotation reagent of claim 1 which further comprises up to 50% by weight of an additional component selected from the group consisting of diethylene glycol, monoethanolamine, diethanolamine, and mixtures thereof.

6. A process for flotation of sulfidic ores comprising containing said sulfidic ores with the flotation reagent of claim 1 to separate the sulfidic ores.

7. The precess of claim 6, said sulfidic ores are non-iron metal ores.

8. The precess of claim 6, said sulfidic ores are selected from the group consisting of copper, molybdenum, lead, zinc, nickel, and mixtures thereof.

9. The precess of claim 6, said sulfidic ores are copper-bearing ores.

10. The precess of claim 6, said sulfidic ores are copper-bearing ores associated with molybdenum and/or gold.

* * * * *